US009642765B2

(12) United States Patent
Weydert

(10) Patent No.: US 9,642,765 B2
(45) Date of Patent: May 9, 2017

(54) GAIT TRAINING APPARATUS FOR GENERATING A NATURAL GAIT PATTERN

(75) Inventor: Serge Weydert, Zurich (CH)

(73) Assignee: MEDICA MEDIZINTECHNIK GMBH, Hochdorf (DE)

( * ) Notice: Subject to any disclaimer, the term of this patent is extended or adjusted under 35 U.S.C. 154(b) by 387 days.

(21) Appl. No.: 14/342,818

(22) PCT Filed: Sep. 6, 2012

(86) PCT No.: PCT/CH2012/000211

§ 371 (c)(1),
(2), (4) Date: Apr. 7, 2014

(87) PCT Pub. No.: WO2013/033855

PCT Pub. Date: Mar. 14, 2013

(65) Prior Publication Data

US 2014/0243717 A1 Aug. 28, 2014

(30) Foreign Application Priority Data

Sep. 9, 2011 (CH) ..... 1493/11

(51) Int. Cl.
*A61H 1/00* (2006.01)
*A61H 1/02* (2006.01)

(52) U.S. Cl.
CPC ..... *A61H 1/008* (2013.01); *A61H 1/0262* (2013.01); *A61H 1/0266* (2013.01)

(58) Field of Classification Search
CPC .. A61H 1/0262; A61H 1/0266; A61H 1/0259; A61H 1/0327; A63B 22/0664; A63B 23/0423; A63B 23/0429
See application file for complete search history.

(56) References Cited

U.S. PATENT DOCUMENTS

| | | | | |
|---|---|---|---|---|
| 219,439 | A | 9/1879 | Blend | |
| 2,969,060 | A * | 1/1961 | Swanda | A61H 1/0237 482/70 |
| 6,312,362 | B1 | 11/2001 | Maresh et al. | |
| 6,364,040 | B1 * | 4/2002 | Klann | B62D 57/032 180/8.1 |
| 6,835,166 | B1 | 12/2004 | Stearns et al. | |

(Continued)

FOREIGN PATENT DOCUMENTS

| | | |
|---|---|---|
| CH | 698214 | 6/2009 |
| CH | 703504 | 1/2012 |

(Continued)

*Primary Examiner* — Justine Yu
*Assistant Examiner* — Kathrynn Lyddane
(74) *Attorney, Agent, or Firm* — Rankin, Hill & Clark LLP

(57) ABSTRACT

A gait training apparatus for the mechanical production of a natural gait pattern. The gait training apparatus includes a first and a second multi-joint mechanism which are mechanically coupled to one another, as well as a drive for the input of a rotatory movement into the first multi-joint mechanism, and a foot support element which is coupled onto the second multi-joint mechanism. The second multi-joint mechanism moreover includes a longitudinal displacement body which is longitudinally displaceable via a longitudinal guide relative to this and which is connected to the first multi-joint mechanism.

16 Claims, 7 Drawing Sheets

(56) References Cited

U.S. PATENT DOCUMENTS

| | | | | |
|---|---|---|---|---|
| 7,673,718 | B2 * | 3/2010 | Asai | A61H 3/008 180/208 |
| 9,149,407 | B2 * | 10/2015 | Hesse | A61H 1/005 |
| 2010/0248903 | A1 | 9/2010 | Cardile | |
| 2010/0268129 | A1 * | 10/2010 | Park | A61H 1/0237 601/35 |
| 2011/0077562 | A1 | 3/2011 | Wang et al. | |

FOREIGN PATENT DOCUMENTS

| | | |
|---|---|---|
| DE | 19725973 | 12/1998 |
| DE | 19805164 | 5/1999 |
| DE | 202008001590 | 7/2008 |
| DE | 102008007580 | 8/2009 |
| EP | 1974778 | 10/2008 |
| WO | 2004/014494 | 2/2004 |

* cited by examiner

GAIT TRAINING APPARATUS FOR GENERATING A NATURAL GAIT PATTERN

BACKGROUND OF THE INVENTION

Field of the Invention

The invention lies in the field of gait training apparatus and relates to a gait training apparatus for the mechanical production of a natural gait pattern, in particular the gait pattern of the sole of the foot. The gait training apparatus in each case comprises a first and second multi-joint mechanism which are mechanically coupled to one another and are for each leg, moreover a drive for the input of a rotatory movement into the first multi-joint mechanism, and a foot support element which is coupled to the second multi-joint mechanism.

A gait pattern in the present description is to be understood as the aggregation of the movements of the individual segments of the lower extremities on walking. The individual segments amongst other things include the thigh, the lower leg and the foot, which are connected to one another via joints. The gait pattern in particular also includes the change of the position of the segments relative to one another. Thus, different points of the lower extremities describe different movement trajectories. For this reason, the gait pattern also cannot be represented by a specific gait curve, but rather by a plurality of movement trajectories of representative points in the lower extremities. Such representative points for example represent the heel point, the toe point as well as joint points, via which the body segments are connected to one another such as e.g. the hip joint, the knee joint and the foot joint.

The gait pattern, apart from the purely geometric movement trajectories, also includes the movement speed of the extremities along their movement path.

Limitations of the musculoskeletal system that are caused by neurological incidents such as accidents or disease, or due to the ageing process, represent a significant challenge for therapists. Stroke patients, cerebral palsy patients, patients with multiple sclerosis and those who suffer from Parkinson's are affected. Various therapy methods exist within neuro-rehabilitation, by way of which the walking ability of the patient concerned can be improved or at least stabilised. Various studies and practice have shown that the repetitive execution of the courses of movement of walking is one possible promising application.

Description of Related Art

It is known e.g. to carry out a therapy on treadmills, by way of therapists moving the lower limbs of the patient by hand. Moreover, mechanically driven training apparatus are also known, with which the legs and/or the feet of the patient are automatically led in a trajectory that approximates the human gait pattern.

US 2011/0077562 A1 for example describes a gait training apparatus for the mechanical production of a natural gait pattern. The gait training apparatus for the mechanical reproduction of the gait pattern in each case of one leg comprises a first four-joint mechanism and a second four-joint mechanism that is coupled to the first one. The joint mechanisms are driven via a drive motor. The gait training apparatus has the disadvantage that the speed of the drive motor necessarily has to be closed-loop controlled for producing a realistic gait pattern. The gait training apparatus moreover does not permit the movement trajectories to be changed by way of mechanical settings or adjustments on the apparatus. A further disadvantage lies in the fact that the gait training apparatus only reproduces a curve of a point, e.g. of the heel or midfoot, and not the desired movement of the complete plane of the ball of the foot. This means that the angle of the foot is not controlled. Moreover, the gait training apparatus has large dimensions due to its mechanical design, is therefore unwieldy, and requires much space.

U.S. Pat. No. 6,312,362 describes a training apparatus for strengthening the muscle system of the leg and mechanically reproduces the gait movement. The training apparatus in each case for one leg comprises a first multi-joint part-mechanism that is responsible for the horizontal and vertical position of the foot along the gait curve, as well as a second multi-joint part-mechanism that is responsible for the inclination angle of the foot. The part-mechanisms are driven via a common drive that feeds a rotatory movement into the system. The training apparatus has the disadvantage that this does not reproduce the human gait pattern in a particularly precise manner. This may be sufficient for a fitness apparatus that merely has the purpose of strengthening the leg muscle system. The apparatus however is not suitable as a gait training apparatus for passively training the gait movement. Moreover, the direct conversion of a rotatory movement into a translatory movement leads to greatly dimensioned apparatus that are unwieldy and require much space.

In the expert field, it is an undisputed fact that the human gait pattern of the individual leg as well as both legs moved in a coordinated manner is an extremely complex matter. The reproduction of the human gait pattern, which is as precise as possible, therefore represents a great challenge. Moreover, one should note that each human has his own gait pattern that amongst other things is based on the anatomy, the gait speed as well as the individual characteristics of the walking movement.

BRIEF SUMMARY OF THE INVENTION

It is the object of the present invention, to suggest a gait training apparatus which is in the position of mechanically reproducing the human gait pattern as precisely as possible. Despite this, the gait training apparatus should have an as simple as possible mechanical construction. Moreover, the possibility of individually adapting the gait pattern to the user by way of mechanical setting possibilities should exist. The gait training apparatus in particular should be applied as a therapy apparatus for improving the walking ability of patients. The gait training apparatus however should also be able to be used as a fitness apparatus for the targeted strengthening or maintenance of the leg muscle system The following explanations with respect to multi-joint mechanisms and a guide device, inasmuch as not specified otherwise, relate to a first part-device of the gait training apparatus which is designed for the movement of a first leg. However, it is to be noted at this location that the gait training apparatus usefully also comprises a second part-device that is designed for the movement of a second leg. This second part-device however is usefully the same with regard to function and preferably also with regard to design, but constructed in a mirror-inverse manner with regard to the first part-device. It is however accordingly operated in a manner shifted in phase to the first part-device, in accordance with the human gait pattern.

The object is achieved by a gait training apparatus according to claim 1. The gait training apparatus in particular is thus characterised in that this comprises a longitudinal guide, wherein the first and the second multi-joint mechanism are mechanically coupled or connected to one another via a longitudinal displacement body, wherein the longitudinal displacement body is in mechanical active connection with the longitudinal guide and is displaceably arranged relative to this.

The longitudinal guide is preferably a mechanical construction element, via which the longitudinal displacement body is guided. The longitudinal displacement body in particular is displaceably arranged along the longitudinal guide. The longitudinal displacement body in particular is translatorily displaceable along the longitudinal guide. The longitudinal displacement body is preferably part of the second multi-joint mechanism. The longitudinal displacement body is further preferably articulately connected to the first multi-joint mechanism.

Further preferred embodiments and further developments of the invention are to be deduced from the dependent patent claims.

The gait training apparatus preferably comprises a fourth multi-joint mechanism for deflection of the longitudinal guide. The deflection preferably affects a lifting and lowering of the longitudinal guide or a part thereof.

As explained further below, the longitudinal guide as part of the third link is preferably connected via a joint point (see thirteenth joint point) to the support frame of the gait training apparatus. The third link now is preferably pivotable via the fourth multi-joint mechanism about the joint point and therefore pivotably liftable and lowerable about the joint point.

The fourth multi-joint mechanism is likewise driven via a drive. The drive is preferably designed for producing a rotatory movement, by way of which the fourth multi-joint mechanism is set into motion.

According to a preferred further development, two or all of the subsequently mentioned multi-joint mechanisms are driven directly or indirectly via a common drive:

first multi-joint mechanism;

second multi-joint mechanism;

fourth multi-joint mechanism.

The drive or drives, e.g. via a shaft, produce a torque which is taken up by the multi-joint mechanisms. Thereby, in each case a first link of the multi-joint mechanism, also called rotation link is set into rotation. I.e., the rotation link rotates about a drive joint point and executes complete revolutions.

In a particularly preferable further development, at least the first, second, in particular the first, second, and fourth multi-joint mechanisms are driven by a common drive. According to this embodiment variant, the first, and, as the case may be, the fourth multi-joint mechanism are preferably driven in a direct manner. This means that the first link of the respective mechanism takes up the torque directly from the drive. The second multi-joint mechanism is preferably driven in an indirect manner. This means that the torque is led from the drive via a further gear arrangement to the first link of the second multi-joint mechanism that is to be driven. The further gear arrangement is preferably arranged on the first multi-joint mechanism or part thereof.

The drive comprises a motor, and, as the case may be, also a gear which converts the speed delivered by the motor to a necessary higher or lower rotation speed. The motor is preferably an electric motor. The speed of the drive can be controlled or regulated (closed-loop controlled) preferably via a control or regulation device respectively.

The drive motor can be arranged such that the motor shaft lies in the rotation axis of the first joint point. The drive motor however with its motor shaft can also be arranged axially offset to the rotation axis of the first joint point. In this case, the torque transmission is effected via a suitable gear, e.g. a toothed belt gear or planetary gear.

In a further development of the invention, the first multi-joint mechanism, as already mentioned above, comprises means for the transmission of the torque from a drive, in particular from a common drive, onto the second multi-joint mechanism. This means that the means are designed to set a first link of the second multi-joint mechanism into rotation. The first link thereby rotates about a drive joint point of the second multi-joint mechanism. Accordingly, the first rotation links of the first and the second multi-joint mechanism preferably rotate synchronously.

According to a preferred embodiment of the invention, the first multi-joint mechanism is designed as a crank mechanism, with a first link that in particular is designed as a crank, as well as with a second link that in particular is designed as a con-rod. A crank mechanism in the present context is to be understood as a functional group that effects the conversion of a rotatory movement into an oscillating longitudinal movement, in particular translatory movement. The term "crank" in the context of this patent application is not to be limited to an elongate construction element, but can e.g. also be a disk-like component. Rather, the crank with regard to design is characterised in that this has two joint points which are distanced to one another, wherein the crank is rotatorily driven via a drive joint point, hereinafter called first joint point, in a manner such that a further joint point, hereinafter called second joint point, on which a further link is fixed, revolves completely around the first joint point.

The second joint point can be displaced with respect to the first link (crank) via suitable displacement means, for the purpose of changing the gait pattern.

The numbering of the joint points merely serves for the identification of these and the differentiation of these from other joint points. The number of a joint point in particular should not be construed in a limiting manner to the extent that the gait training apparatus necessarily has to have a corresponding number of joint points. If for example, within the scope of the disclosure one speaks of a twelfth joint point, then this is not to be construed to the extent such that the gait training apparatus, apart from the twelfth joint point necessarily has to have eleven further joint points.

The joint points in each case are distinguished in that these form rotation joint connections with rotation axes, which permit the partial or complete rotation of the links, connected to one another via the joint point, relative to one another. The respective links are therefore articulately connected to one another via the joint points. The rotation joint connection can be designed in different manners according to the known type and manner. Thus, for example this can comprise a rotation axis/pivot connecting the links to one another. The rotation joint connections should simply permit a rotation movement of the components concerned, relative to one another. The rotation joint connections, depending on the function of the joint points, can permit rotation movements of less than 360° or complete revolutions.

The first link of the first multi-joint mechanism in then rotatorily drivably connected to the drive via a first joint point (drive joint point). The first and second link are connected to one another via a second joint point. The second link is connected via a further joint point, hereinafter called third joint point, to the longitudinal displacement body that is preferably a constituent of the second multi-joint mechanism.

The functioning manner of the first multi-joint mechanism, as can also be derived from the figures, lies in the fact that the crank is rotatorily driven by the drive via the first joint point, so that the second joint point, on which the second link is attached, rotates about the first joint point. The rotation drive at the third joint point, at which the second link is connected to the longitudinal displacement body, causes a longitudinal displacement of the longitudinal displacement body along the longitudinal guide. The longitudinal guide limits the relative movement of the longitudinal displacement body, in a manner such that its degree of freedom is 1. This relative movement or guidance movement is preferably a sliding movement, wherein two points of the longitudinal displacement body are guided on a common or on two different guide paths of the longitudinal guide. The guidance movement is preferably linear. The longitudinal displacement body in this case is a translation body relative to the longitudinal guide. However, one can also envisage the longitudinal movement at least in sections running in a non-linear, e.g. arched manner, or the two points of the longitudinal displacement body being led on two different guide paths of the longitudinal guide.

According to a further development of the invention, the second multi-joint mechanism is a multi-joint linkage (multi-joint coupler mechanism), in particular a four-bar linkage with a movable first and third link. A second link designed as a coupler (connecting link) connects the first and the third link to one another. A fourth link, specifically the longitudinal displacement body, forms the reference link, with which the first and the third link are connected. The reference link represents that link of a multi-joint mechanism which itself is not driven or moved by the multi-joint mechanism concerned.

A linkage in the present context is to be understood as a mechanism that converts rotation movements into oscillating or arcuate movements. Linkages in this context are mechanisms that transmit in a non-uniform manner.

The four-bar linkage in particular is designed as a crank rocker. The crank rocker also called crank mechanism belongs to the linkages. As all linkages, it is characterised by the coupling of at least two of the movable links to a coupler. The first link in the embodiment of a crank is used as a drive, and the third link in the form as a rocker is used as an output.

The first link now according to this embodiment is designed as a crank and via a joint point, hereinafter called fourth joint point, is rotatorily drivably fastened on the longitudinal displacement body which represents the reference link of the four-bar linkage. The second link is designed as a coupler and via a further joint point, hereinafter called fifth joint point, is connected to the first link. Moreover, the second link is connected via a further joint point, hereinafter called sixth joint point, to a third link which is designed as a rocker. The third link is connected via a further joint point, hereinafter called seventh joint point, to the longitudinal displacement body, the reference link.

The term "rocker" in the present context is not to be limited to an elongate construction element, but e.g. can also be a disk-like component. Rather, the rocker with regard to design is characterised in that this has two joint points which are distanced to one another, wherein a first joint point serves as a rotation axis, about which, driven by the coupler, the second joint point oscillates, i.e. swings or rocks.

The third and fourth joint point are preferably arranged in a common rotation axis on the longitudinal displacement body and thus coincide. The second link of the crank mechanism (con-rod) in this case via the third joint point is directly connected to the longitudinal displacement body, the reference link of the second multi-joint mechanism and likewise to the first link (crank) of the second multi-joint mechanism. However, one can also envisage the third and fourth joint point being arranged on the longitudinal displacement body at a different location.

The fourth and seventh joint point of the second multi-joint mechanism are then located on the longitudinal displacement body and together with this are displaced in an oscillating longitudinal manner via the driven first multi-joint mechanism. The two joint points are fixedly arranged relative to one another. Accordingly, the complete second multi-joint mechanism is also subjected to an oscillating longitudinal movement by the moved longitudinal displacement body. This longitudinal movement partly contributes to the step length of the gait movement.

According to a further development of the invention, the gait training apparatus comprises a third multi-joint mechanism which is connected to the second multi-joint mechanism, and on which the foot support element is formed.

The gait training apparatus moreover preferably comprises a further longitudinal displacement body that is mechanically coupled or connected to the third multi-joint mechanism. The further longitudinal displacement body is in mechanical active connection with a longitudinal guide and is displaceably arranged relative to this.

This further longitudinal displacement body is hereinafter indicated as the second longitudinal displacement body, and the longitudinal displacement body introduced further above as the first longitudinal displacement body.

The longitudinal guide of the second longitudinal displacement body is hereinafter called the second longitudinal guide, and the longitudinal guide introduced further above is hereinafter called the first longitudinal guide.

The first longitudinal guide and/r the second longitudinal guide are preferably part of the third link of the fourth multi-joint mechanism.

The second longitudinal guide can be designed as a separate or independent further longitudinal guide with respect to the first longitudinal guide.

The first and the second longitudinal guide however can also be a common longitudinal guide. This means that the second longitudinal guide corresponds to the first longitudinal guide and the first and second longitudinal displacement body move along a common longitudinal guide. Accordingly, in this case, the first and the second longitudinal guide is preferably part of the third link of the fourth multi-joint mechanism.

The second longitudinal displacement body in particular is arranged displaceably along the second longitudinal guide. The displacement in particular is a translatory displacement. The second longitudinal guide is preferably a mechanical construction element, via which the second longitudinal displacement body is guided. The second longitudinal displacement body is preferably a constituent of the third multi-joint mechanism.

The second longitudinal guide can be mechanically coupled to the first longitudinal displacement body, in a manner such that the second longitudinal guide co-moves with the first longitudinal displacement body given a displacement of the first longitudinal displacement body along the first longitudinal guide. The second longitudinal guide in this case is not part of the third link of the fourth multi-joint mechanism.

Thus, for example, the second longitudinal displacement body on the one hand is displaceable along the second longitudinal guide, and on the other hand via the first longitudinal displacement body also along the first longitudinal guide. The movements of the second longitudinal displacement body along the first and second longitudinal guide can superimpose. The second longitudinal guide can for example be part of the first longitudinal displacement body. The second longitudinal guide can be connected to the first longitudinal displacement body.

This further longitudinal guide, on which the second longitudinal displacement body is arranged, functions analogously to the first one. It limits the relative movement of the second longitudinal displacement body with respect to the longitudinal guide, in a manner such that its degree of freedom is 1. This relative movement or guidance movement is preferably a displacement or sliding movement, wherein two points of the second longitudinal displacement body are led on a common or two different guide paths on the longitudinal guide. The guide movement is preferably linear. The second longitudinal displacement body in this case is a translation body relative to the longitudinal guide. However, one can also envisage the longitudinal movement at least in sections running in a non-linear, e.g. arched manner or the two points of the second longitudinal displacement body being led on two different guide paths of the longitudinal guide.

The third multi-joint mechanism is connected via a joint point, hereinafter called eighth joint point, to the second multi-joint mechanism, in particular to its second link. The firth multi-joint mechanism for this, apart from the second longitudinal displacement body, moreover preferably comprises a first part-link that via the eighth joint point is connected to the second multi-joint mechanism and via a further joint point, hereinafter called ninth joint point, is fastened on the second longitudinal displacement body. Moreover, the third multi-joint mechanism preferably comprises a second part-link that is preferably rigidly connected to the first part-link. Rigid means that the two part links are not connected to one another via joint points and accordingly are not rotatorily movably displaceable to one another. The second part-link is moreover likewise preferably rigidly connected to the foot support element. The two part-links together can be formed as a single-part component. The two part-links can also be designed as separate components.

If the second multi-joint mechanism is designed as a four-bar linkage and in particular as a crank rocker, thus the second link (coupler) preferably has three joint points that are arranged in a triangular configuration. With regard to these joint points, it is the case of the already mentioned fifth, sixth and eight joint points. The triangle configuration can for example be realised via a triangular linkage, whose corner points represent the joint points. The triangular configuration can however also be realised via a disk element.

The functioning manner of the second and third multi-joint mechanism, as can also be derived from the figures, then lies in the first link (crank) of the second multi-joint mechanism being rotatorily driven, wherein the third link (rocker) is set into an oscillating movement about the seventh joint point via the second link (coupler). By way of this, the eighth joint point which is fixed on the coupler executes a curved path movement relative to the reference element (first longitudinal displacement body) and this movement is preferably lemniscate or loop-like (a lying eight). This movement of the eighth joint point firstly now effects a longitudinal displacement of the second longitudinal displacement body and accordingly also of the third multi-joint mechanism, and secondly an angular course of the two part-links of the third multi-joint mechanism. In this manner, the foot support element and a foot support surface formed thereon is longitudinally displaced and led at an angle.

The step length of the gait movement now amongst other things arises due to the longitudinal movement of the second longitudinal displacement body. Moreover, the pivot movement of the foot support element about the joint point with the second longitudinal displacement body contributes to the step length. The longitudinal movement of the second longitudinal displacement body in turn arises firstly due to its relative movement with respect to the first longitudinal displacement body (caused by the second and third multi-joint mechanism) and secondly due to the movement of the first longitudinal displacement body (triggered by the first multi-joint mechanism).

The multi-joint mechanisms are thereby of a nature and coupled to one another such that the two longitudinal displacement bodies although moving with different speeds, however for the most part move in a common direction. The second longitudinal displacement body for the most part moves at a higher speed compared to the first longitudinal displacement body, in a common movement direction. Thus, the second longitudinal displacement body moves in a backwards movement to the first longitudinal displacement body and in a forwards movement away from the first longitudinal displacement body. The longitudinal displacement bodies are e.g. arranged one after the other seen in the longitudinal displacement direction.

The gait movement spans a movement plane, in which for example the movement trajectories of the gait pattern lie. The coupler planes of the second and third multi-link linkage for example lie parallel to the movement plane. The movement planes of the first and third multi-joint mechanism also preferably lie parallel to the movement plane of the gait movement. Moreover, the guide paths of the longitudinal guides preferably also run parallel to the movement plane. The longitudinal guides can e.g. be designed as guide rails or as a common guide rail. The longitudinal displacement bodies can e.g. be designed as slides that in particular are led on the mentioned guide rail.

The foot support element preferably forms a foot support surface, on which the foot is placed with the sole of the foot. The foot support element further preferably comprises a fixation device for fixing the foot on the foot support element. In a further development of the invention, means can be provided on the foot support element, which give the foot freedom of movement with respect to the foot support element. These can be spring elements that e.g. permit a limited lateral tilt movement as well as a tilt movement of the foot to the rear or to the front, with respect to the foot support element, or even torsion movements of the foot with respect to the foot support element. This optional measure should likewise serve for therapy purposes and animate the user to actively assume control over his foot position or movement. The foot support element can e.g. comprise a foot plate, which forms the foot support element.

The means on the first multi-joint mechanism for the transmission of torque onto the second multi-joint mechanism, according to a preferred embodiment comprise the following components:

- a first transmission wheel which is rigidly connected to the first, rotationally driven link (crank) of the first multi-joint mechanism, as well as
- a second transmission wheel which is connected to the first link of the second multi-joint mechanism, or is in mechanical active connection with this, in a manner such that the first link can be rotatorily driven via the transmission wheel.

The second transmission wheel is preferably rigid, and e.g. is connected via a shaft to the first link of the second multi-joint mechanism. In this manner, the drive moment is transmitted from the second transmission wheel onto the first link of the second multi-joint mechanism. Moreover, the second transmission wheel is connected via the third joint point likewise to the first longitudinal displacement body.

The first transmission wheel and the second transmission wheel are connected to one another via a flexible force transmission element wrapping around the wheels. The force transmission element is preferably a drive belt, such as toothed belt or flat belt, or a drive chain. The wheels are preferably toothed wheels (cogs) or pinions. In this case, the force transmission is effected positively. The force transmission can however also be effected with a friction fit. The first transmission wheel and the second transmission wheel preferably have an equally large diameter and thus run synchronously, in order to retain the relative phase position between the multi-joint mechanisms over several cycles.

The second transmission wheel is then driven via the force transmission element, wherein the force transmission element for its part is driven or set into motion by way of the first transmission wheel revolving around the first joint point.

The rotation point of the second transmission wheel preferably lies on the third joint point so that the third and the fourth joint point coincide and the stretch between the middle points of the first and second transmission wheel always co-moves with the second link of the first multipoint mechanism, so that the length of the force transmission element does not need to vary, i.e. the distance of the middle points of the first to the second transmission wheel always remains the same. The transmission wheel in this case is rotatably mounted on the second link (rocker).

Instead of the embodiment described above, an additional drive can also be provided on the first longitudinal displacement body, said drive rotatorily driving the first link of the second multi-joint mechanism. The further drive does not need to be attached on the longitudinal displacement body, but can also be arranged at a different location and transmit the torque via a gear onto the fourth joint point which is fixed there. The drive however usefully runs synchronously, i.e. at the same rotatory speed, to the drive of the first joint mechanism.

The fourth multi-joint mechanism for the deflection of the longitudinal guide is preferably likewise a multi-joint linkage, in particular a four-bar linkage, of the type described above, with a first and a third link which are connected to one another via a second link which is designed as a coupler. The four-bar linkage in particular is designed as a crank rocker. The first link which in particular is designed as a crank is fastened on a drive in a rotatorily drivable manner via a joint point, hereinafter called tenth joint point. The second link (coupler) is connected to the first link via a further joint point, hereinafter called eleventh joint point. Moreover, the second link is connected via a further joint point, hereinafter called twelfth joint point, to the third link, which in particular is designed as a rocker. The third link comprises the longitudinal guide of the first and/or second longitudinal displacement body or consists of this. The longitudinal guide is thus part of the fourth multi-joint mechanism. The third link is connected via a further joint point that is distanced to the twelfth joint point, and is hereinafter called thirteenth joint point, to the support structure of the gait training apparatus.

If the first and second multi-joint mechanisms are driven via a common drive, then the tenth and the first joint point preferably lie in a common rotation axis. It is even conceivable for the first link (crank) of the first and fourth multi-joint mechanism to be formed together and on the one hand for the first and tenth joint point to be identical as well as on the other hand for the second and the eleventh joint point to coincide.

The functioning manner of the fourth multi-joint mechanism, as can be deduced from the figures, now lies in the first link (crank) being rotatorily driven by the drive via the tenth joint point, so that the eleventh joint pint, on which the second link (coupler) is attached, rotates about the tenth joint pint. The rotation drive via the second link creates an oscillating lifting and lowering movement of the twelfth joint point and thus also of the third link, which comprises the longitudinal guide or forms this.

The angle of the gait movement is then composed of the angular course of the longitudinal guide (created by the fourth multi-joint mechanism) and of the relative angular course of the two part-links of the third multi-joint mechanism and which superimposes on this. The lifting and lowering of the foot in the gain movement in contrast is chiefly created by the fourth multi-joint mechanism. Moreover, the pivot movement of the foot support element about the joint point with the second longitudinal displacement body contributes to the lifting and lowering movement of the foot.

The fourth multi-joint mechanism is preferably designed in a manner such that the third and the second link in a lower rotation angle region of the first link exert an equally directed rotation movement, so that the joint point between the second and third link for a certain time duration or over a certain rotation angle region moves up and down only insignificantly. This has the effect that the foot support element in a movement phase, which corresponds to the ground contact of the feet, practically only moves horizontally. This movement course can be achieved e.g. by way of the distance between the tenth and the eleventh as well as the distance between the eleventh and twelfth joint point being equally large.

The support structure comprises non-moving parts of the gait training apparatus, on which parts the joint mechanisms described above are attached or suspended. The support structure thus carries or supports the joint mechanisms. The support structure can e.g. be a housing, a framework, a stand or a frame or a combination of these mentioned assemblies. The support structure can e.g. be formed by profiles.

As already mentioned above, for each leg, it is useful to provide a part-device described above and these are advantageously designed mirrored to one another. The two part-devices can be driven via a separate, e.g. two drives, in each case with an individual drive motor or via a common drive with a single drive motor. The two part-devices are phase-shifted according to the human gait, i.e. as a rule 180°. The drives can be operated at a constant or variable [rotation] speed. Preferably, the drives for a further approximation of the mechanically produced gait pattern to the real gait pattern are operated at a variable rotation speed according to a predefined rotation speed course. The differences in the movement speed of the foot in the gait pattern of a human can reproduced along the gait curve to an improved extent by way of this.

In a preferred further development of the invention, the gait curve can be set by way of adjustment means on the gait training apparatus. In particular, the length of the gait curve can be set by way of the adjustment means The length of the gait curve for example can be set by way of the adjustment means permitting the adjusting of the distance between the first joint point, at which the first link of the first multi-joint mechanism is rotatorily driven, and the second joint point, at which the second link is articulately connected to the first link of the first multi-joint mechanism. The rotation radius of the second joint point about the first joint point can be changed by way of this.

The adjustability can be affected via an adjustment mechanism. The adjustment mechanism can for example comprise a screw flight. The adjustment mechanism can alternatively also comprise an elongate hole guide. Moreover, it is also possible for the adjustment mechanism to comprise a locking mechanism, e.g. with a rack rail.

The first and second links are preferably part of the adjustment mechanism. The adjustment mechanism can be actuated by hand or also via a drive, in particular an electric drive. The electric drive can e.g. be a linear motor.

Alternatively or additionally to this adjusting possibility, the gait curve, in particular the length of the gait curve can also be changed by way of adjustment means which permit the adjusting of the distance between the foot support surface of the foot support element and the ninth joint point, via which the third multi-joint mechanism is articulately connected to the second displacement body. The pivot radius of the foot support surface of the foot support element about the ninth joint point can be changed by way of this. This for example can be affected by way of the position of the foot support surface of the foot support element being changeable along the second part-link towards the ninth joint point or away from this. An adjustment mechanism of the type described above can be provided for this.

The gait training apparatus further comprises a weight relief device, which accommodates at least a part of the body weight, so that the body weight no longer completely bears upon the lower extremities. The weight relief device can be a suspension, e.g. with belts and/or cables, which ensure a passive weight relief of the legs. "Passive" means that the user does not have to assume any force effort himself for weight relief. The user in the suspension is fixed e.g. on and/or above the hip. This can be a complete or a partial weight relief depending on the design and setting of the suspension. Such a device in particular is applied in therapy apparatuses.

Moreover, the weight relief device can also consist of means which permit the active weight relief, e.g. via the arms. "Active" means that the user achieves the weight relief of the legs only by his own force effort. Thus for example bar-like hand grips can be provided, which permit a support of the body via the arms.

The gait training apparatus is applied as a therapy apparatus for improving the walking ability of persons, as mentioned above. The walking movement is hereby trained by way of the foot support elements being moved via the drive or drives and the multi-joint mechanisms, whilst forming a gait pattern. Thereby, different training modes are conceivable, in which the user trains either in a passive manner (i.e. does not need to muster his own force for carrying out the gait movement), or in an active manner (i.e. must carry out the gait movement partly with his own force).

The latter is possible via a suitable control and regulation (closed-loop control) device. The gait training apparatus thereby only accounts for a part of the necessary drive force via the drives. The control and regulation device can thereby regulate the drive power also in dependence on the contribution of the user. Modes with which the patient must muster the complete force himself or with which the drive even provides resistance are also conceivable.

The latter design in particular in a further development as a fitness apparatus can be used for the targeted strengthening or preservation of the leg muscle system of persons.

The present gait training apparatus has the advantage that with regard to design, this is constructed in a simple manner and can be realised with comparatively few components. Moreover, standard components that are available on the market can be used for a multitude of components. Accordingly, the gait training apparatus is also inexpensive in manufacture as well as simple in assembly and maintenance.

A further essential advantage lies in the fact that the gait training apparatus has a compact and therefore space-saving construction. This is not a certain thing in the light of a purely mechanical implementation of a complex gait movement. This advantage amongst other things is due to the fact that the step length as a linear movement component of the gait movement is not derived directly from a single rotation movement, but is composed of at least two longitudinal movements.

BRIEF DESCRIPTION OF THE DRAWINGS

The subject-matter of the invention is hereinafter explained in more detail by way of preferred embodiment examples, which are represented in the accompanying drawings. In each case shown schematically are.

The reference numerals used in the drawing and their significance are listed in a grouped manner in the list of reference numerals. Basically, the same parts are provided with the same reference numerals in the figures.

DETAILED DESCRIPTION OF THE INVENTION

Figure 1:
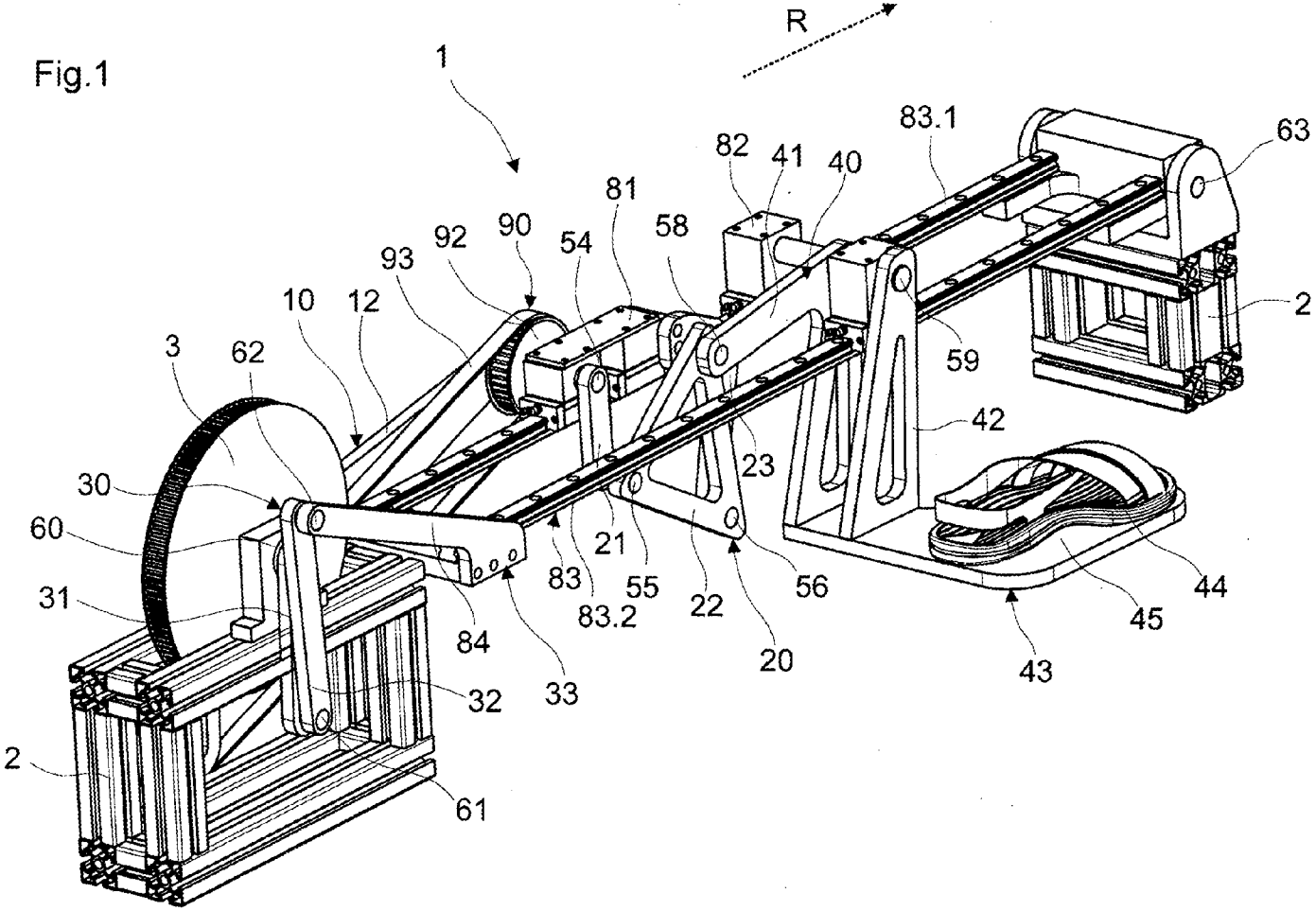
FIG. 1 is a perspective view of a gait training apparatus.
Figure 2:
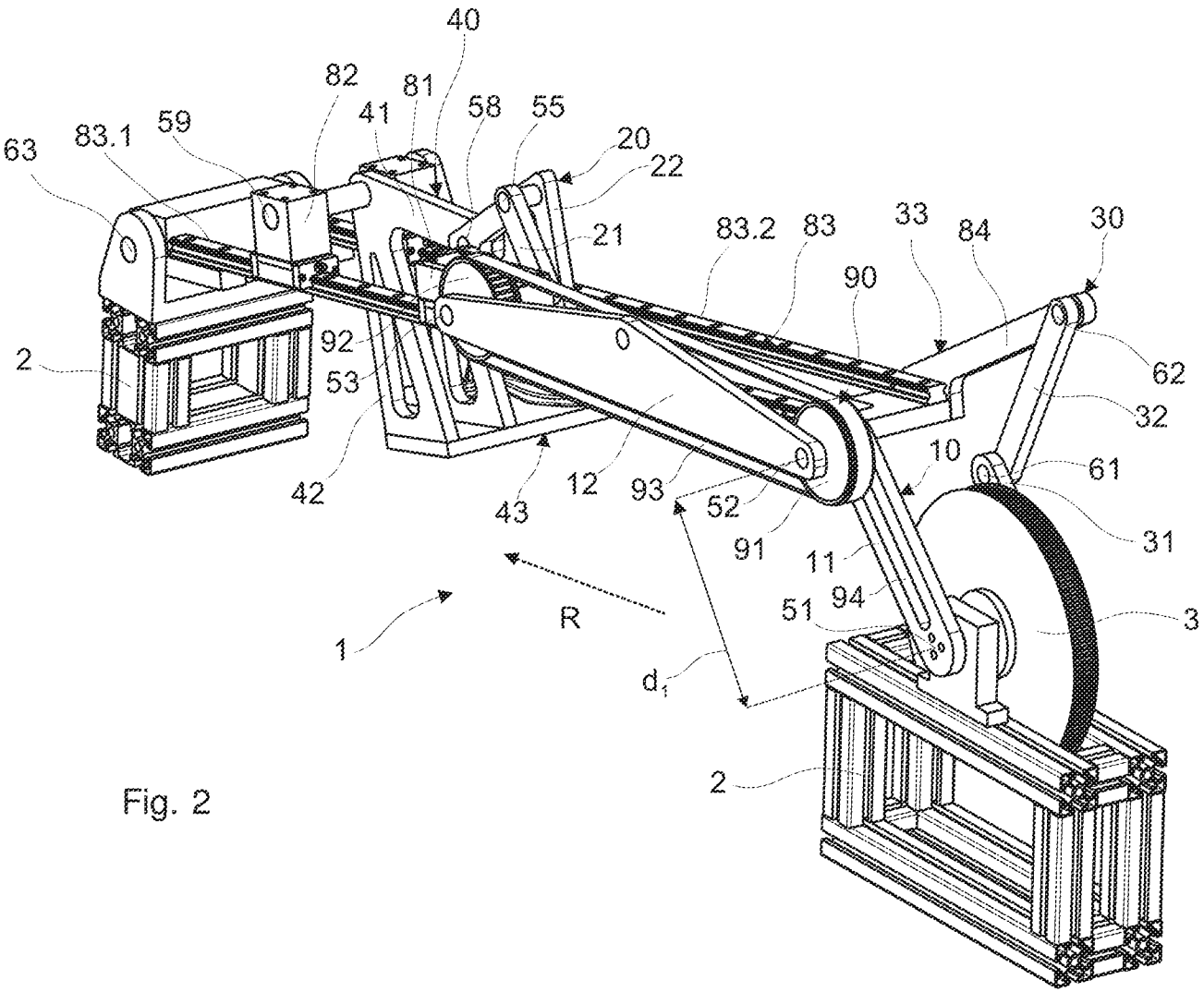
FIG. 2 is a further perspective view of the gait training apparatus.
Figure 3:
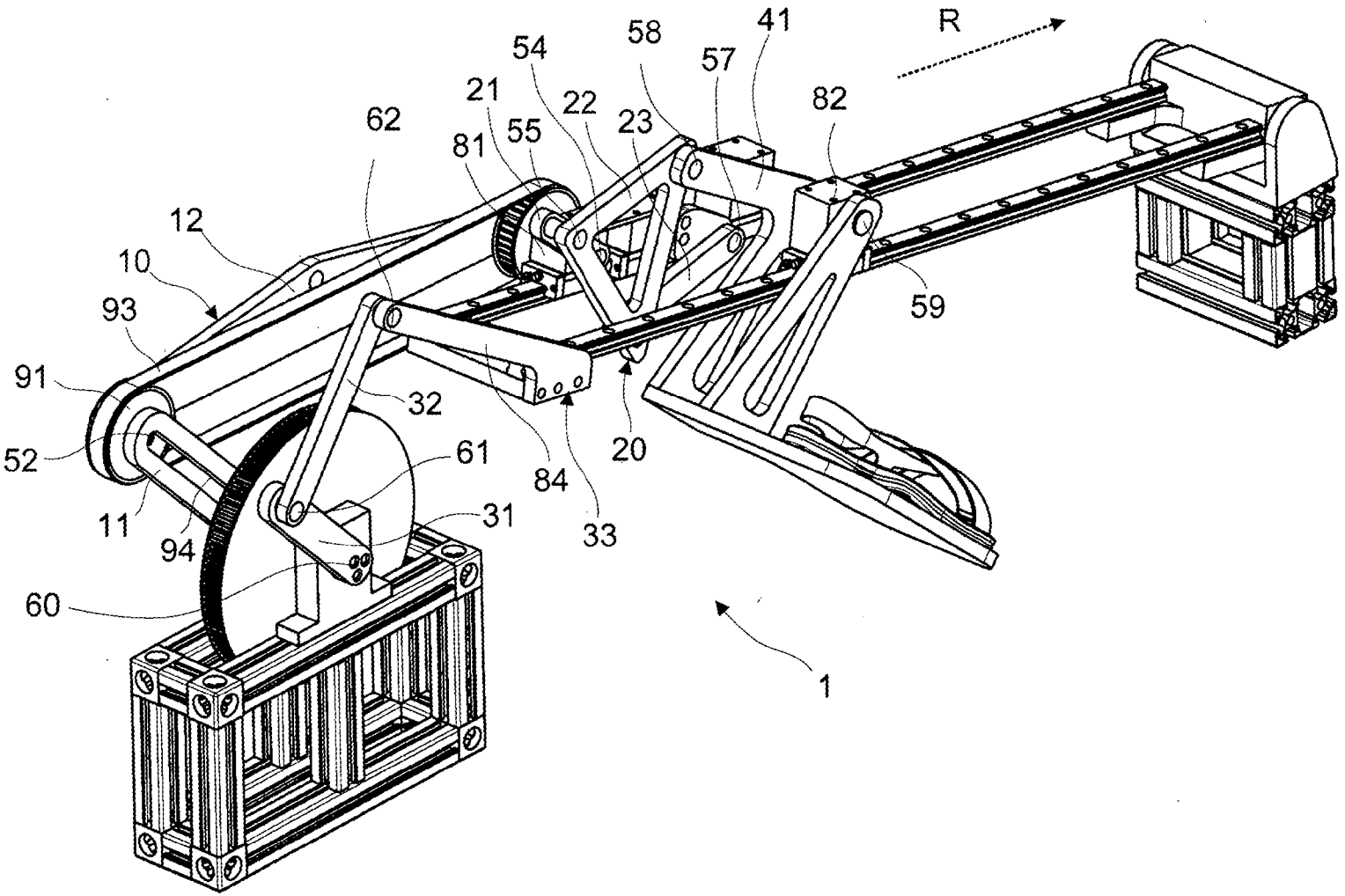
FIG. 3 is a further perspective view of the gait training apparatus.

FIGS. 1 to 3 show a functional model of a gait training apparatus 1 according to the invention, in various views. FIGS. 1 and 3 show the gait training apparatus from a perspective view from the rear and the right, and FIG. 2 from a perspective view from the rear and the left. Moreover, FIG. 1 shows the gait training apparatus in a first position, in the so-called standing phase of walking (with a horizontally aligned foot support surface 45), whereas FIG. 2 in a second position shows a condition shortly before the end of the swing phase of walking, and FIG. 3 in a third position, shows a condition at the beginning of the swing phase.

The gait training apparatus 1 comprises a fixed support structure 2, on which the subsequently described joint mechanisms 10, 20, 30 40 are directly or indirectly fastened. The gait training apparatus 1 comprises a first multi-joint mechanism 10 in the embodiment of a crank mechanism. The first multi-joint mechanism is driven via a drive 3 and comprises a first link 11 (crank) which is driven via a first drive joint point 51. The first link 11 for this is coupled to a shaft (not shown). The drive 3 comprises an electric motor (not shown) which transmits the drive moment via a belt drive onto the shaft.

The first multi-joint mechanism 10 is supported on the support structure 2 via the first drive joint point 51. The first link 11 is connected via a second joint point 52 to the second link 12 (con-rod). The second link 12 is connected via a third joint point 53 to a translation body 81 (first longitudinal displacement body and reference link of the second multi-joint mechanism). The translation body 81 is linearly displaceably arranged along a guide rail 83 (longitudinal guide). The linear displacement is effected in an oscillating movement, caused by the movement of the second link 12.

Moreover, the gait training apparatus 1 comprises a second multi-joint mechanism 20 in the embodiment of a crank rocker. A first link 21 (crank) is connected via a fourth joint point 54 to the translation body 81 and is rotatorily driven. Since the translation body 81 moves in an oscillating manner linearly along the guide rail 83, the second multi-joint mechanism 20 is co-moved accordingly. The first link 21 (crank) is connected via a fifth joint point 55 to a second link 22 (coupler). The second link 22 (coupler) is connected via a sixth joint point 56 to a third link 23 (rocker) which for its part is connected via a seventh joint point 57 to the translation body 81 (reference link). The fourth and seventh joint point 54, 57 are thus arranged on the translation body 81 in a fixed manner to one another.

The second link 22 moreover comprises an eighth joint point 58, wherein the fifth, sixth and eighth joint point 55, 56, 58 form a triangular arrangement.

The first multi-joint mechanism 10 comprises means 90 for transmitting torques, for the drive of the first link 21 (crank) of the second multi-joint mechanism 20. The means 90 comprise a first transmission wheel 91 which is fastened on the first link 11 in a rotationally fixed manner, wherein the circle centre of the first transmission wheel 91 lies in the rotation axis of the second joint point 52. Moreover, a second transmission wheel 92 is rotatably mounted on the second link 12, wherein its rotation axis lies in the rotation axis of the third joint point 53, which is however not compelling. In contrast, what is compelling is that the rotation axis of the output wheel 92 lies in the rotation axis of the fourth joint point 54, on which the first link 21 of the second multi-joint mechanism is fixed. In the present embodiment example, the rotation axis of the first joint point 54 corresponds to the rotation axis of the third joint point 53.

The first transmission wheel 91 and the second transmission wheel 92 are designed as cogs. With regard to drive, they are connected to one another via a toothed belt 93. If now the first link 11 rotates about the first joint point 51, then the first transmission wheel 91 describes a revolving path about the first joint point 51. The toothed belt 93, which is led around the first transmission wheel 91 with a positive fit, is set into motion by way of the revolving movement of the first transmission wheel 91, since the first transmission wheel 91 is attached on the first link 11 in a rotationally fixed manner. The movement of the toothed belt 93 is transmitted onto the second transmission wheel 92, around which the toothed belt 93 is likewise positively wrapped. The second transmission wheel 92 is set into rotation by way of this, and drives the first link 21 of the second multi-joint mechanism 20. For this, the second transmission wheel 92 and the first link 21 are rigidly connected to one another, in the present embodiment via a shaft.

The rotation movement of the two first links 11, 21 of the first and second multi-joint mechanism 10, 20 is accordingly synchronous. Deflection rollers can be additionally provided and these ensure an improved force transmission from the toothed belt 93 onto the second transmission wheel 92 or from the first transmission wheel 91 onto the toothed belt 93 (not shown).

The second joint point 52 can be set along the first link 11 relative to this via an elongate hole guide 94. I.e. the distance $d_1$ between the first and the second joint point 51, 52 can be set. The amplitude of the oscillating linear movement of the translation body 81 and thus of the step length of the gait movement can be changed by way of this.

The gait training apparatus 1 moreover comprises a third multi-joint mechanism 40 with a first and a second part-link 41, 42 which are at an angle to one another and are rigidly connected to one another, as well as a translation body 82 (second longitudinal displacement body). The first part-link 41 is now connected via the eight joint point 58 to the second link 22 (coupler) of the second multi-joint mechanism 20. The second part-link 42 comprises a foot support element 43. The foot support element 43 forms a foot support surface 45. Moreover, the foot support element 43 comprises a fixation device 44 for fixing the foot (not shown) on the foot support element 43. The first and second part-link 41, 42 are connected to the translation body 82 via a common ninth joint point 59.

The first and second translation body 81, 82 are arranged one after the other in the longitudinal guidance direction, via a common guide rail 83.1. The second translation body 82 is additionally yet led on a second guide rail 83.2 running parallel to the first one, for reasons of design technology.

The second multi-joint mechanism 20 now introduces a movement into the forth multi-joint mechanism 40 via the eighth joint point 58 and this movement on the one hand has a component parallel to the guide rail 83 or to the longitudinal movement direction of the first translation body 81, by which means the second translation body 82 is likewise set into a linear movement along the guide rail 83 in an absolute manner as well as relative to the first translation body 81. The forth multi-joint mechanism 40 and with this, the foot support element 43 is then moved in a complete movement parallel to the longitudinal guidance direction of the translation bodies 81, 82, said complete movement being composed of the longitudinal movement of the first and a relative longitudinal movement of the second translation body 81, 82 which is superimposed on this.

Simultaneously, the second multi-joint mechanism 20 via the eighth joint point 58 also initiates a pivot movement into the third multi-joint mechanism 40 that effects an angle change of the foot support surface 45 along a movement path of the foot support surface 43. The second and third multi-joint mechanism are designed such that an irregular pivot movement is produced, which approximates the natural gait movement.

The gait training apparatus 1 moreover comprises a fourth multi-joint mechanism 30, likewise in the embodiment of a crank rocker. The multi-joint mechanism 30 comprises a first link 31 (crank) which is driven via a tenth drive joint point 60 by the same drive as the first multi-joint mechanism 10. The rotation axes of the first and the tenth joint point 51, 60 are therefore identical. The first link 31 is connected via an eleventh joint point 61 to a second link 32 (coupler). The second link 32 is connected via a twelfth joint point 62 to a third link 33, the rocker. The third link 33 amongst other things comprises the longitudinal guide, designed here as a guide rail 83, as well as an angled connection component 84 that is rigidly connected to the guide rail 83, and via which the third link 33 is connected to the second link 32.

The guide rail 83 moreover at the other end is connected to the support structure 2 via a thirteenth joint point 63. The twelfth and thirteenth joint point 62, 63 are arranged distanced to one another, so that the third link 33 acts as a rocker.

The twelfth joint point 61 and with this, the third link 33 is set into an oscillating up and down movement by way of the rotational drive of the first link 31. Thereby, the third link 33 and accordingly the guide rail 83 pivot about the thirteenth joint point 63. This movement is carried out simultaneously with the drive of the first and second multi-joint mechanism 20, 30, so that a superimposed movement pattern arises, which comes very close to the natural gait movement of a human.

FIGS. 4 to 7 show functional diagrams of the gait training apparatus according to the invention, in different movement positions or situations. The schematically represented construction elements correspond essentially to the construction features according to the embodiment example according to FIGS. 1 to 3. For this reason, the corresponding construction elements are provided with the same reference numerals.

Figure 4:
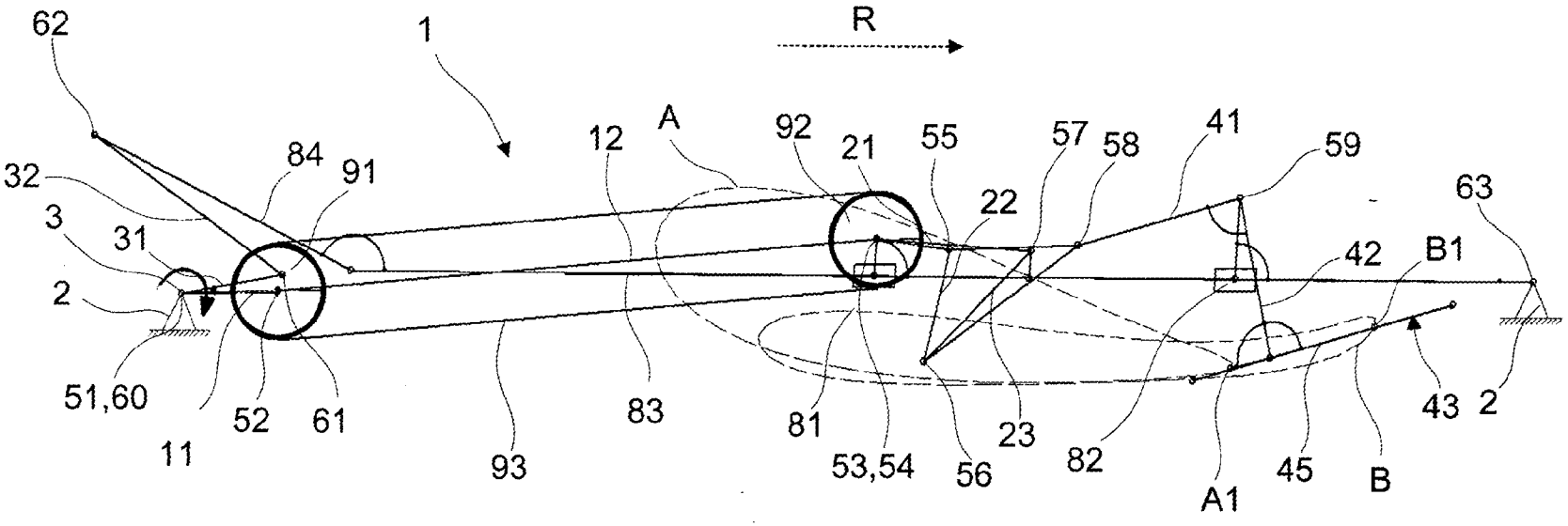
FIG. 4 is a functional diagram of the gait training apparatus.
Figure 5:
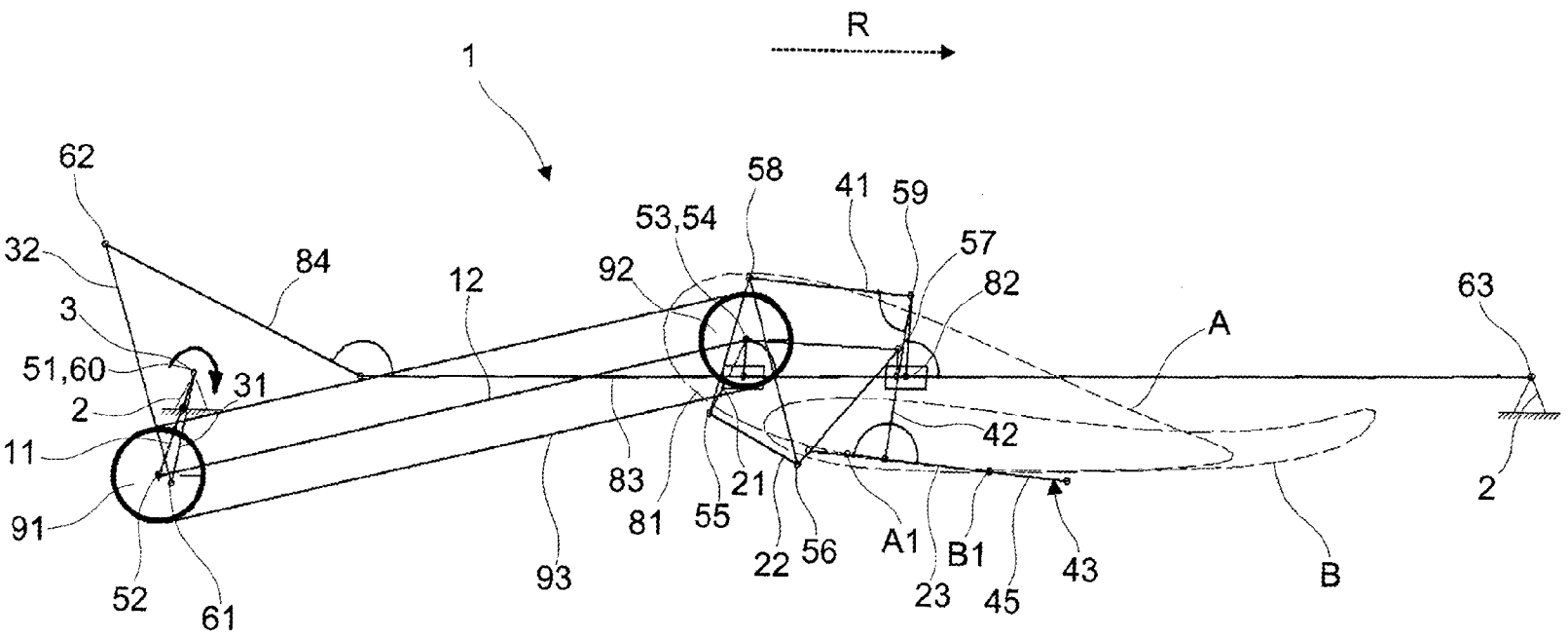
FIG. 5 is a functional diagram of the gait training apparatus.
Figure 6:
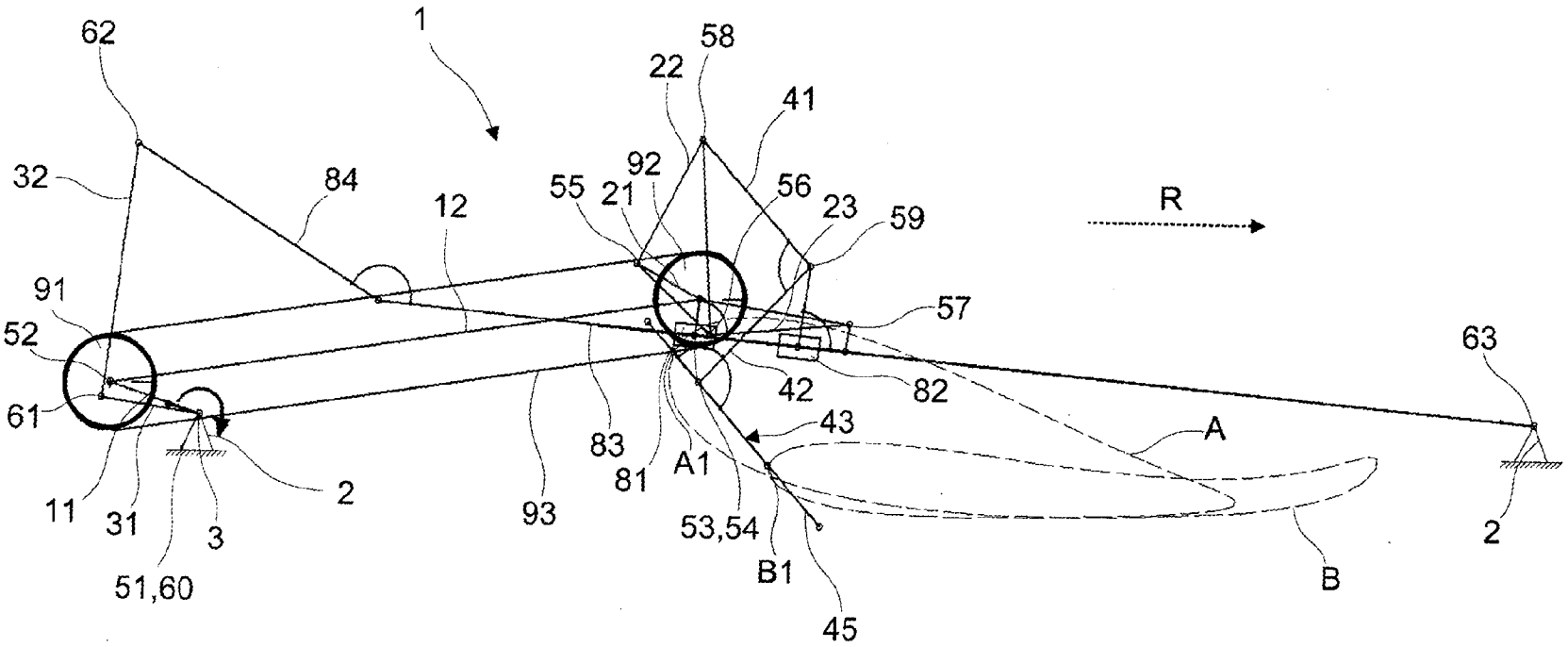
FIG. 6 is a further functional diagram of the gait training apparatus.
Figure 7:
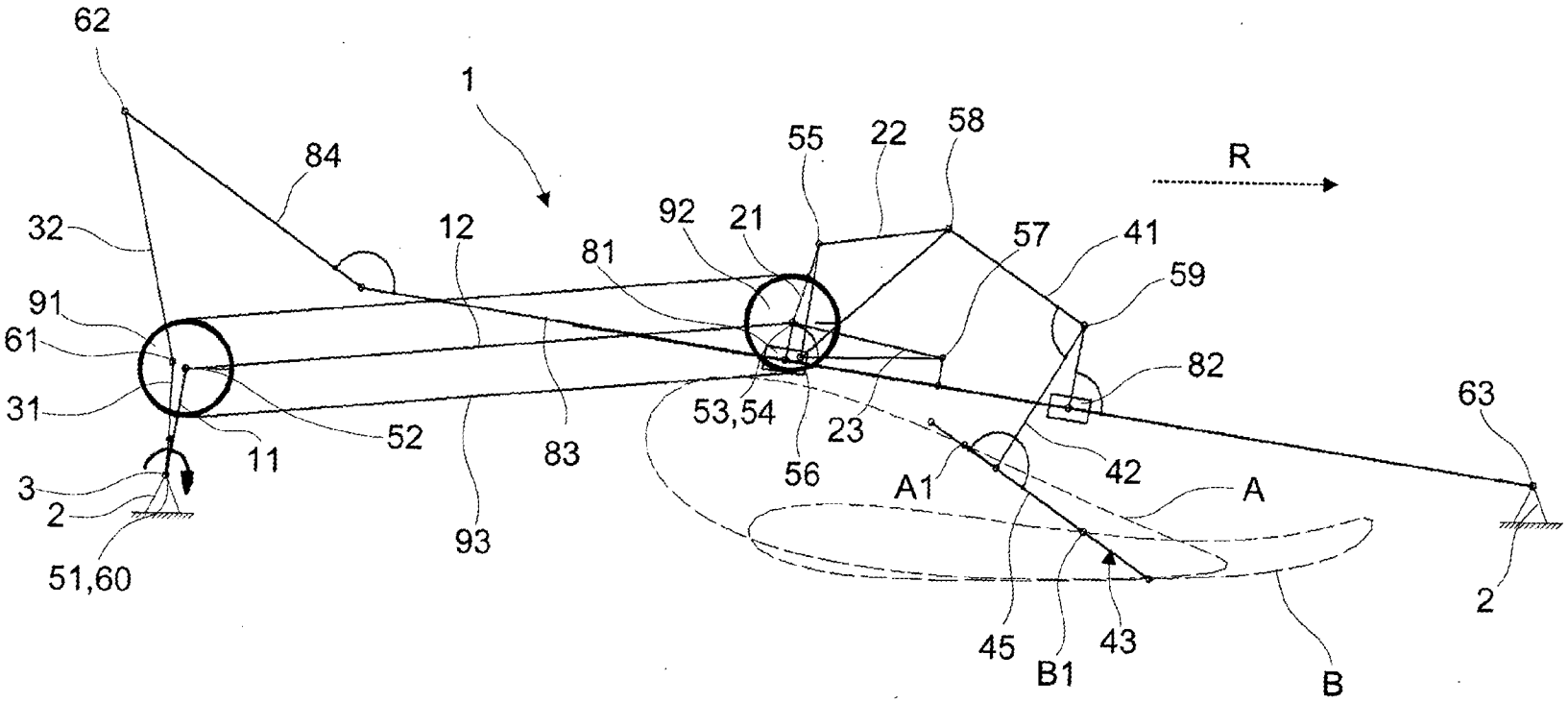
FIG. 7 is a further functional diagram of the gait training apparatus.

Moreover, the gait curve A of a heel point A1 as well as the gait curve B of a point of the ball of the toe B1 are also schematically represented in the FIGS. 4 to 7. The mentioned points A1, B1 during a complete movement cycle move along the gait curve A, B assigned to them. FIG. 4 shows the movement position on placing the foot onto the ground. FIG. 5 shows the movement situation on rolling the foot on the ground. FIG. 6 shows the movement position on pushing the foot from the ground subsequent to the rolling movement. FIG. 7 shows the movement position with the forwards movement of the leg, with which the foot is still angled.

The direction of the forwards movement during the running movement is indicated by the arrow R in the FIGS. 1 to 7.

The invention claimed is:

1. A gait training apparatus for producing a natural gait pattern, comprising:

a first and a second multi-joint mechanism which are mechanically coupled to one another, a drive for introducing a rotatory movement into the first multi-joint mechanism, a foot support element, and at least one longitudinal guide, wherein the first and the second multi-joint mechanism are coupled to one another via a first longitudinal displacement body, wherein the first longitudinal displacement body is in mechanical active connection with the at least one longitudinal guide and is displaceably arranged along the at least one longitudinal guide, wherein the gait training apparatus comprises a third multi-joint mechanism on which the foot support element is arranged, wherein the third multi-joint mechanism is mechanically connected to the second multi-joint mechanism, wherein the first multi-joint mechanism comprises means for transmitting torque from the drive onto the second multi-joint mechanism, wherein the first multi-joint mechanism is a crank mechanism, with a first and second link, and the first link is connected to the drive in a rotatorily drivable manner via a first joint point, and the second link is connected to the first longitudinal displacement body via a third joint point, and the first and second links are connected to one another via a second joint point, wherein the second multi-joint mechanism is a multi-joint linkage, with a third link which is rotatorily drivably connected to the first longitudinal displacement body via a fourth joint point, and with a fourth link which is connected to the third link via a fifth joint point, and with a fifth link which is connected to the fourth link via a sixth joint point and to the first longitudinal displacement body via a seventh joint point.

2. The gait training apparatus according to claim 1, further comprising a fourth multi-joint mechanism for lifting and lowering of the at least one longitudinal guide.

3. The gait training apparatus according to claim 1, wherein the first and second multi-joint mechanisms are driven via the drive.

4. The gait training apparatus according to claim 1, wherein the third multi-joint mechanism is connected to a second longitudinal displacement body, wherein the second longitudinal displacement body is in mechanical active connection with the at least one longitudinal guide and is displaceably arranged along the at least one longitudinal guide.

5. The gait training apparatus according to claim 4, wherein the third multi-joint mechanism includes:

a first part-link which is connected via an eighth joint point to the fourth link of the second multi-joint mechanism, and via a ninth joint point to the second longitudinal displacement body, and a second part-link which is rigidly connected to the first part-link and to which the foot support element is rigidly connected.

6. The gait training apparatus according to claim 5, wherein the means for transmitting torque includes:

a first transmission wheel which is rigidly connected to the first link of the first multi-joint mechanism, a second transmission wheel which is connected to the third link of the second multi-joint mechanism in a manner such that the third link is rotatorily drivable via the second transmission wheel, wherein the first transmission wheel and the second transmission wheel are connected to one another via a flexible force transmission element wrapping around the first and the second transmission wheels, and the second transmission wheel is drivable via the flexible force transmission element by way of the revolving of the first transmission wheel about the first joint point.

7. The gait training apparatus according to claim 1, wherein both the second link of the first multi-joint mechanism and the third link of the second multi-joint mechanism are connected to one another on the first longitudinal displacement body via the third joint point.

8. The gait training apparatus according to claim 1, wherein the first longitudinal displacement body is part of the second multi-joint mechanism and is not driven or moved by the second multi-joint mechanism.

9. The gait training apparatus according to claim 4, wherein the second longitudinal displacement body is part of the third multi-joint mechanism and is not driven or moved by the third multi-joint mechanism.

10. The gait training apparatus according to claim 4, wherein the first and second longitudinal displacement bodies are arranged on the same longitudinal guide.

11. The gait training apparatus according to claim 1, wherein the first longitudinal displacement body is linearly displaceable along the at least one longitudinal guide.

12. The gait training apparatus according to claim 1, further comprising adjusting means that allow a distance between the first joint point and the second joint point to be adjusted.

13. The gait training apparatus according to claim 2, wherein the fourth multi-joint mechanism is driven via the drive.

14. The gait training apparatus according to claim claim 1, wherein the multi-joint linkage is a four-bar linkage.

15. The gait training apparatus according to claim 4, wherein the first longitudinal displacement body is arranged only on a first longitudinal guide, and the second longitudinal displacement body is arranged on a second longitudinal guide.

16. The gait training apparatus according to claim 4, wherein the second longitudinal displacement body is linearly displaceable along the at least one longitudinal guide.

* * * * *